United States Patent [19]

Lugosi

[11] 3,973,428

[45] Aug. 10, 1976

[54] UNIFORM LAND LENGTH DIE

[75] Inventor: Robert Lugosi, Monroeville, Pa.

[73] Assignee: Westinghouse Electric Corporation, Pittsburgh, Pa.

[22] Filed: Apr. 7, 1975

[21] Appl. No.: 565,501

[52] U.S. Cl. ..... 72/467; 72/60

[51] Int. Cl.[2] ..... B21C 25/02

[58] Field of Search ..... 72/60, 467, 260, 271, 72/274, 468

[56] References Cited

UNITED STATES PATENTS

| | | | |
|---|---|---|---|
| 1,836,821 | 12/1931 | Singer | 72/468 |
| 1,924,734 | 8/1933 | Brown | 72/467 |
| 2,894,623 | 7/1959 | Walton | 72/467 X |
| 3,178,925 | 4/1965 | Nolan et al. | 72/467 X |
| 3,303,530 | 2/1967 | Cobb, Jr. | 425/461 |
| 3,583,204 | 6/1971 | Nilsson | 72/467 |
| 3,618,351 | 11/1971 | Thompson | 72/60 |
| 3,747,384 | 7/1973 | Nilsson | 72/60 |
| 3,756,054 | 9/1973 | Nilsson | 72/60 |

*Primary Examiner*—Milton S. Mehr
*Attorney, Agent, or Firm*—R. D. Fuerle

[57] ABSTRACT

A die is internal for forming shapes of polygonal cross-section, which has all internal surfaces which are parallel to the die axis of equal length. The die is primarily used in hydrostatic extrusion. It can be made in two parts for ease in cleaning. A billet having a pointed, faceted nose for use with the die is also disclosed.

23 Claims, 5 Drawing Figures

FIG.1
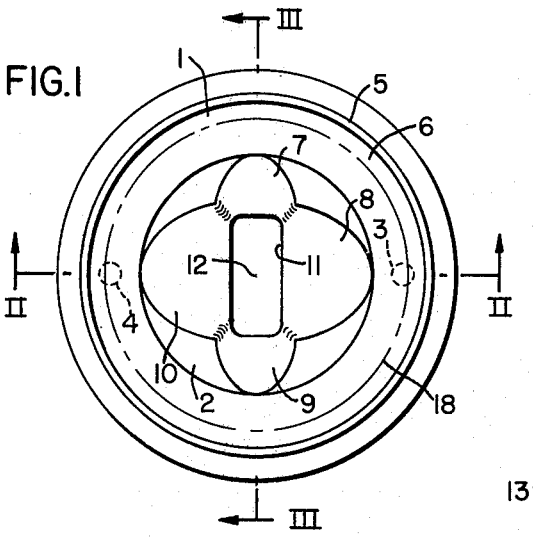
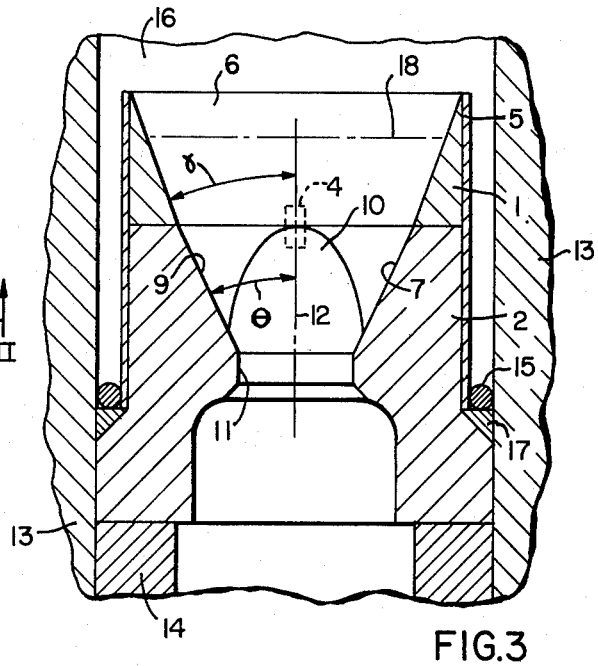
FIG.3
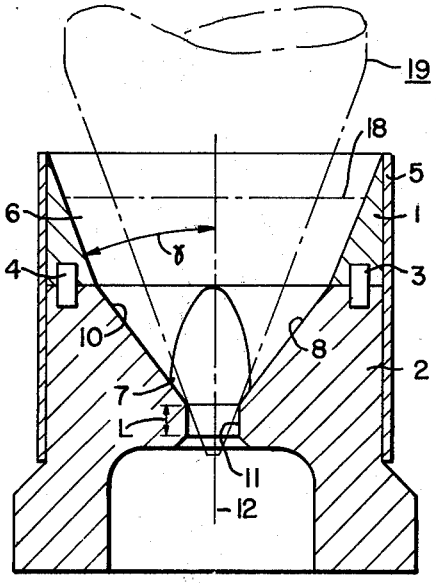
FIG.2
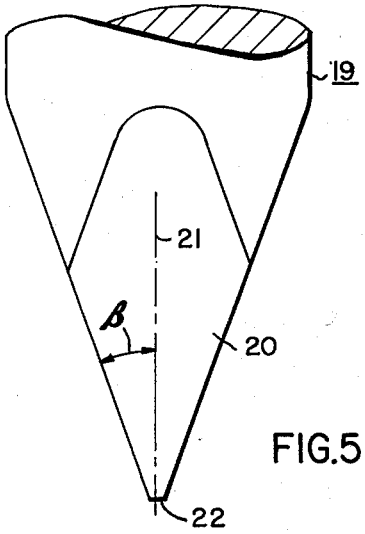
FIG.5
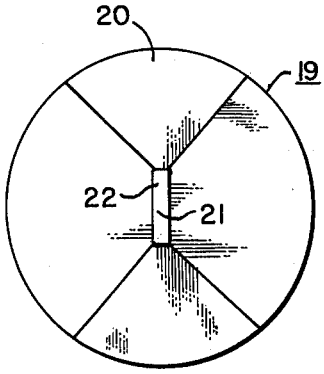
FIG.4

UNIFORM LAND LENGTH DIE

BACKGROUND OF THE INVENTION

Dies used for forming rectangular wire are generally made with a conical inlet portion and a rectangular shaping portion having parallel walls which intersect the conical inlet portion. The line of intersection is a parabola with its apex towards the shaping portion. Thus, the walls of the rectangular portion are not of equal length.

PRIOR ART

U.S. Pat. No. 3,583,204 discloses a billet having a chisel-shaped nose and a rectangular die where opposite sides of the parallel surfaces are of equal length.

Articles by B. Avitzar in the November 1965 Journal of Engineering for Industry and by P. F. Hettwer et al. in the December 1969 Translation of the ASME state that for round wire shorter land lengths mean that lower extrusion pressures are required.

SUMMARY OF THE INVENTION

I have found that a die for forming shapes of polygonal cross-section where all internal surfaces parallel to the die axis are of equal length requires less breakthrough and run-out pressure than does an identical die where the internal parallel surfaces are not of equal length.

As a result, the dies of this invention require less power to use and therefore cost less overall. Lower pressures means a longer pressure chamber life, a longer die life, and better lubrication in hydrostatic extrusion. Also, because lower pressures are needed, the dies can be used to shape metals which require pressures which would otherwise be in excess of the capabilities of the forming machine. Finally, removal of the butt-end of the billet is easier because the parallel surfaces in the die are not as long.

DESCRIPTION OF THE DRAWINGS

FIG. 1 is an end view of a certain presently preferred embodiment of a die according to this invention.

FIG. 2 is a cross-sectional view through II—II in FIG. 1.

FIG. 3 is a cross-sectional view through III—III in FIG. 1, except that the die has been shown in a portion of a hydrostatic extrusion machine.

FIG. 4 is an end view of a billet suitable for use with the die of FIGS. 1, 2 and 3.

FIG. 5 is a side view of the billet shown in FIG. 4.

In FIGS. 1, 2, and 3 the die has two sections 1 and 2, aligned by pins 3 and 4 and held together by sleeve 5. The die is composed of conical entry surface 6 and a faceted surface having four facets 7, 8, 9, and 10, each of which extend from one side of four-sided shaping portion 11, the only internal part of the die (before the shape leaves the shaping portion of the die) which has parallel sides, all of equal length (the "land length," L in FIG. 2). The land length should be kept as small as possible in order to keep the force required to move the billet through the die low, although too small a land length will cause the die to wear out rapidly. The land length generally depends upon the diameter of the billet and larger billets will require longer land lengths. A practical range for the ratio of the billet diameter to the land length is about 10 to about 15, although lower ratios may be suitable for soft metals and higher ratios may be required for hard metals.

The angle from the die axis 12 to conical entry surface 6 (the "conical angle" $\gamma$ in FIGS. 2 and 3) is preferably about 45° to about 75° as smaller angles require a billet which is too pointed and larger angles increase the breakthrough pressure. While the least angle from the die center to the faceted surface (the "facet angle" $\theta$ in FIG. 3) may be less than the conical angle, it is preferably greater than or equal to the conical angle as this gives improved metal deformation characteristics. For shapes having an even number of sides, opposite facet angles are preferably equal; also, each facet forms a parabola where it intersects with the conical surface, and the apices of these parabolas are preferably equidistant from the shaping portion of the die. The distance from the shaping portion to these apices is preferably about 25 to about 75% of the distance from the shaping portion to the point on the conical surface (phantom line 18 in the drawings) which forms a circle equal to the diameter of the billet (measuring along the die axis). The intersections of the faceted surfaces with each other and with the conical surface are preferably rounded at a small (e.g., about 0.5 to about 2.0 mm) radius in order to reduce the extrusion pressure.

FIG. 3 shows the die in a portion of a hydrostatic extrusion machine. The die is supported laterally by walls 13 and is held in place by tube 14. An electrical O-ring 15 seals in hydrostatic fluid in pressure chamber 16 when the pressure is low, and a chamber ring 17 seals in the fluid when the pressure is high. In the preferred embodiment shown in the drawings, the hydrostatic fluid can flow around the outside of the die as far down as shaping portion 11. While this arrangement is not required, it is more optimal because the fluid pressure on the outside of the die exactly opposes the pressure of the billet passing through the shaping portion, and thereby helps to prevent deformation of the die. A billet (not shown) fits into pressure chamber 16 with the perimeter of the billet during extrusion contacting the die at dotted line 18. The billet is surrounded by a fluid such as castor oil which is placed under pressure to force the billet through the die.

FIGS. 5 and 6 show a billet suitable for use with the die shown in FIGS. 1, 2, and 3. The billet 19 is of circular cross-section, but has a four-sided, pointed nose 20.

The angle from the center line of the billet 21 to a side of its nose (angle $\beta$ in FIG. 5) is less than the corresponding facet angle of the die in order to reduce breakthrough pressure; about 5° to about 10° less is preferred. The apices of the parabolas formed by the intersection of the nose facets with the round portion of the billet are preferably equidistant from the tip of the nose.

A cross-section through the nose is rectangular in shape and that rectangle is approximately congruent with rectangular shaping portion 11. The nose is blunted at 22 for safety in handling, but the rectangle at the tip is smaller than rectangular shaping portion 11 so that the nose contacts portion 11 at all points to form a seal. The diameter of the billet is equal to the diameter of circle 18 in FIGS. 1, 2, and 3. The ratio of the cross-sectional area of the billet to the cross-sectional area of the shaping portion of the die is preferably about 5 to about 50. Generally, as a practical matter, the billet should be larger than the die opening at the apices of the faceted surfaces, and, of course, the billet must be smaller than the entry diameter of the die.

The die of FIGS. 1, 2, and 3 can also be made as a single piece, although the die of the drawings facilitates easier die maintenance. The die can be made by electro-discharge machining or by other processes. The shape extruded may be any shape of a polygonal cross-section (i.e., a closed shape of at least three flat sides) including triangular, rectangular (including square), pentagonal, and hexagonal. This polygonal cross-section is a convex region (i.e., a line connecting any two points on the boundary lies entirely within the polygon). The product shape will generally be about 2 mm to about 2 cm in diameter although larger and smaller sizes are possible. The shape is a metal (e.g., copper, aluminum, or steel) of uniform or composite composition. The die is especially suitable for use in hydrostatic extrusion processes due to the high pressures involved, but it can be also used in a drawing process, or in a process which is a combination of hydrostatic extrusion and drawing. Hydrostatic extrusion pressures are described in the literature; an extrusion velocity (of the product) of about 700 to about 2000 feet per minute is generally suitable.

EXAMPLE

A single-piece die was prepared for the extrusion of rectangular wire. The shaping portion of the die measured 0.787 cm. by 0.363 cm. and the land length was 0.15 cm. The conical angle was 22° 30′ and the facet angles were 37° and 27°. The parabola apices were about 100% of the distance from the shaping portion of the die to a point on the conical portion which formed a circle 15.95 cm. in diameter, the diameter of the billet. Thus, the billet was of smaller diameter than is preferred.

The die was placed in a hydrostatic extrusion machine. A 17.8 cm. long annealed electrolytic tough pitched (50 diamond pyrimid hardness) billet 15.95 cm. in diameter with a blunted nose portion about 2.25 cm. long was jammed into the die. The cross-section of the nose was congruent with the shaping portion of the die and formed a seal with it. No lubricant was used except for that provided by the hydrostatic fluid, castor oil. A ram velocity of 6.1 cm. per minute was used. The ratio of the cross-sectional area of the billet to the cross-sectional area of the product was 7.

The experiment was repeated using an identical die (i.e., same conical angle and shaping portion cross-section) but with a non-uniform land length. The billet used had a blunted conical nose with a nose angle 5° smaller than the conical angle of the die. The ram velocity, and other variables were the same. The following tables gives the results (in psi):

| | Prior Art Variable Land Length Die | Constant Land Length Die of This Invention | Pressure Difference Between The Two Dies |
|---|---|---|---|
| Breakthrough Pressure | 138,425 | 103,451 | 34,974 (34%) |
| Steady State Pressure | 107,187 | 97,388 | 9,799 (10%) |

The above table shows the dramatic reduction in breakthrough pressure and the very significant reduction in steady state pressure achieved by the die of the invention. Comparable results have been achieved using aluminum wire and also using square dies.

I claim as my invention:

1. A die comprising:

1. a shaping portion which determines the ultimate shape of a billet passed through said die, said shaping portion,
   a. in cross-section enclosing a space which is both a polygon and a convex region, and
   b. having all internal surfaces which are parallel to the die axis of equal length; and
2. an entry portion having two internal surfaces,
   a. a conical surface sloping towards said shaping portion at an angle A to said die axis, and
   b. a faceted portion which consists of a flat facet leading from each side of said polygon to said conical surface at an angle to said die axis at least as great as angle A.

2. A die according to claim 1 wherein said polygon is a rectangle.

3. A die according to claim 2 wherein said rectangle is a square.

4. a die according to claim 1 wherein said polygon is about 2 mm to about 2 cm in diameter.

5. A die according to claim 1 wherin the ratio of the diameter of a billet to be used in said die to the length of said parallel internal shaping surfaces is about 10 to about 15.

6. A die according to claim 1 wherein said angle between said axis and said conical surface is about 45° to about 75°.

7. A die according to claim 1 wherein said polygon has an even number of sides and the angles between said axis and the facets extending from opposite sides of said polygon are equal.

8. A die according to claim 1 wherein the intersection between each facet and said conical surface forms a parabola and the apex of each parabola is the same distance from said shaping portion of siad die.

9. A die according to claim 8 wherein the distance from said shaping portion of said die to said apices is about 25 to about 75% of the distance from said shaping portion of said die to the position on said conical surface where a cylinder of the diameter of a billet to be used with said die would intersect therewith.

10. A die according to claim 8 wherein the apices of said parabola are at the intersection of said conical surface and said faceted surface.

11. A die according to claim 1 wherein the intersection of each of said facets with said conical surface and with each other is rounded at a radius of about 0.5 to about 2.0 mm.

12. A die according to claim 1 wherein the external diameter of said die at said conical surface and extending through said shaping portion is less than the external diameter of said die past said shaping portion.

13. A die according to claim 1 which is formed from two sections, one section containing all of said shaping portion and the other section containing at least part of said entry portion, including means for aligning said sections.

14. A die according to claim 13 wherein said aligning means is at least two pins extending between apertures in each section and a sleeve on the outside of said die which extends over both sections.

15. A die according to claim 13 wherein said facets are entirely included within said section which contains said shaping portion.

16. A die according to claim 1 in combination with a billet comprising a rod of circular cross-section having a pointed, faceted nose of polygonal cross-section, the diameter of said billet being less than the largest diameter of said aperture in said entry portion, the geometry of a cross-section of said billet through said nose being approximately congruent to the geometry of a cross-section through said shaping portion of said die, and the angle between a facet of the nose of said billet and the axis of said billet being less than the corresponding angle between said entry portion and the axis of said die.

17. A die according to claim 16 wherein said nose is blunted.

18. A die according to claim 16 wherein the ratio of the cross-sectional area of the billet to the cross-sectional area of the shaping portion of the die is about 5 to about 50.

19. A die according to claim 16 where the angle between said facet of said nose and said billet axis is about 5° to about 10° less than the angle between said entry portion and said die axis.

20. A die according to claim 1 wherein the angle between said axis of said billet and said die where said formed shape exits from said die is less than 90°.

21. A method of forming an elongated shape which in cross-section is both a polygon and a convex region, comprising, A. forming a round, elongated billet of larger diameter than said shape, having a pointed, faceted nose, a cross-section through said nose forming a polygon smaller, but approximately congruent with the cross-sectional polygon of said shape:

B. placing said billet in a die which comprises, 1. a shaping portion which
   a. in cross-section encloses a space identical to the cross-section of said elongated shape; and
   b. has all internal surfaces which are parallel to the die axis of equal length;
2. an entry portion having two internal surfaces,
   a. a conical surface sloping towards said shaping portion at an angle A to said die axis, and
   b. a faceted portion which consists of a flat facet leading from each side of said polygon to said conical surface at an angle to said die axis at least as great as angle A, the nose of said billet resting against said shaping portion;

C. forcing said billet through said die.

22. A method according to claim 21 wherein said billet rests against said shaping portion in sealed relationship therewith and said billet is forced through said die by the pressure of a fluid on said billet.

23. A method according to claim 21 wherein the nose of said billet extends through said die and said billet is forced through said die at least in part by pulling said nose.

* * * * *